United States Patent [19]

Taguchi et al.

[11] Patent Number: 4,518,890

[45] Date of Patent: May 21, 1985

[54] IMPREGNATED CATHODE

[75] Inventors: Sadanori Taguchi, Tokyo; Toshiyuki Aida, Chofu; Shigehiko Yamamoto, Tokorozawa; Yukio Honda, Fuchu, all of Japan

[73] Assignee: Hitachi, Ltd., Tokyo, Japan

[21] Appl. No.: 456,247

[22] Filed: Jan. 6, 1983

[30] Foreign Application Priority Data

Mar. 10, 1982 [JP] Japan ..... 57-36412

[51] Int. Cl.[3] ..... H01J 1/14; H01J 19/06; H01K 1/04

[52] U.S. Cl. ..... 313/346 R; 313/346 DC; 252/521

[58] Field of Search ..... 313/346, 346 DC, 337; 252/509, 521

[56] References Cited

U.S. PATENT DOCUMENTS 3,358,178 12/1967 Figner et al. ..... 313/346 R
3,719,856 3/1973 Koppius ..... 313/346
3,922,428 11/1975 Cronin ..... 313/346 R
4,007,393 2/1977 Van Stratum et al. ..... 313/346 R
4,350,920 9/1982 Bertens ..... 313/346 R
4,400,648 8/1983 Taguchi et al. ..... 313/346 R

FOREIGN PATENT DOCUMENTS

EP0091161 10/1983 European Pat. Off. ..... 313/346

*Primary Examiner*—Saxfield Chatmon
*Attorney, Agent, or Firm*—Antonelli, Terry & Wands

[57] ABSTRACT

An impregnated cathode comprises a porous refractory substrate of refractory material such as tungsten containing at least one of scandium oxide particles and oxide particles containing scandium such as $(Al, Sc)_2O_3$, and an electron emissive material impregnated into pores of the substrate, and has an operating temperature lower by about 300° C. than that of the conventional impregnated cathode containing no scandium oxide particles, or scandium.

16 Claims, 6 Drawing Figures

IMPREGNATED CATHODE

BACKGROUND OF THE INVENTION

This invention relates to an impregnated cathode for use in electron tubes such as picture tubes, camera tubes, etc.

The impregnated cathode is a promising cathode for electron tubes with a higher performance, and is prepared by impregnating the pores of a porous metal body with an electron emissive material. The porous metal body has been so far made from tungsten, but it is not restricted only to tungsten and can contain refractory metal such as molybdenum, tantalum, etc. The electron emissive material is alkaline earth metal oxides, which comprises barium oxide (BaO) and at least one compound of aluminum oxide ($Al_2O_3$), calcium oxide (CaO), magnesium oxide (MgO), etc.

Description will be made hereunder, referring to the porous tungsten body as a typical one and a barium aluminate compound as a typical electron emissive material. The porous tungsten body is prepared from tungsten powder as a starting material by press-shaping the powder, presintering the shaped product in a hydrogen atmosphere at a temperature of 1,000° to 1,200° C., thereby making the handling easier, sintering the presintered product in an unoxidative atmosphere by direct heating by passage of electric current, etc. therethrough and subjecting the sintered product to a machining process, thereby obtaining a cathode of desired form. Direct application of the machining process to the sintered product is difficult to work with, and thus the sintered product is impregnated with copper or plastic to facilitate the machining process, and then is machined to a desired cathode form. Then, the copper or plastic is removed by heated evaporation or by dissolution with an acid.

Porosity of porous tungsten body depends upon the particle size of starting material tungsten powder, press-shaping pressure and sintering conditions in combination. An appropriate porosity is usually about 17 to about 30% by volume on the basis of the sintered tungsten body. Any porosity can be provided by selecting the individual conditions as mentioned above, and thus a porous tungsten body having a desired porosity can be obtained by press-shaping a porous tungsten body having the desired cathode form at first, and then sintering the porous tungsten body. It is rather advantageous to carry out press-shaping at first and then sintering, since the cathodes for picture tubes or camera tubes are usually small in sizes. Furthermore, since this process has no step for impregnating a sintered product with copper or for machining the product into the desired cathode form or for removing the copper, etc. therefrom, the process can be simplified.

Uniform distribution of pores in a porous tungsten body can be obtained by selecting relatively mild sintering conditions under which powder particles can be bonded to one another, because distribution is deteriorated under strict sintering conditions under which the tungsten powders are excessively sintered.

The impregnated cathode can be prepared by placing a barium aluminate compound on the thus prepared porous tungsten body and heating the body in a reduction or unoxidative atmosphere, thereby impregnating the pores of the body with the melted compound, or alternately, the pores of the porous tungsten body can be impregnated with the barium aluminate compound by dipping the body in a molten bath of the compound. While the impregnated cathode is actually used, the tungsten in the body reacts with the barium aluminate compound to form elemental barium, and the elemental barium reaches the surface of the body, i.e. the electron emitting surface, and undergoes surface migration to form a monolayer suitable for electron emission. The thus prepared impregnated cathode is regarded as a promising cathode capable of maintaining a high electron emission for a prolonged time, and its application to small electron tubes such as picture tubes, camera tubes, etc. is not under development. It has a high electron emission, but its operating temperature is as high as 1,050° to 1,200° C., so the evaporation of barium or barium oxide is vigorous, giving a serious influence upon the properties of tubes due to its deposition onto other electrode, or the material of electrode in the oxide-coated cathode or a material of sleeve must be replaced due to the high operating temperature. Furthermore, a heater for the impregnated cathode has such a disadvantage that it fails due to the prolonged use. Thus, investigation has been so far made for electron emissive materials capable of operating at a low temperature, but has not been succeeded yet.

On the other hand, an impregnated cathode, whose electron emissive surface is coated with osmium (Os), osmium (Os)-ruthenium (Ru) alloy, iridium (Ir), osmium (Os)-iridium (Ir) alloy, etc. to a thickness of a few hundred nm, can have a lower operating temperature, for example, by about 150° C. (For example, Japanese Patent Publication No. 2134/72), where the surface is coated by evaporation, sputtering, etc. However, more lowering of operating temperature, for example, by about 150° C. does not solve all the foregoing problems satisfactorily.

SUMMARY OF THE INVENTION

An object of the present invention is to provide an impregnated cathode capable of operating at much lower operating temperature, which has distinguished characteristics free from the said problems.

The object of the present invention can be attained by an impregnated cathode which comprises a porous refractory substrate containing scandium oxide ($Sc_2O_3$) or oxide particles containing scandium scattered therein and an electron emissive material impregnated in pores of the porous refractory substrate.

DETAILED DESCRIPTION OF THE PREFERRED EMBODIMENTS

Figure 1:
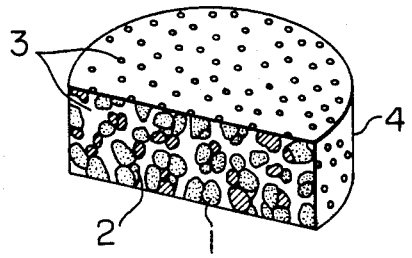
FIG. 1 is a cross-sectional schematic view of an impregnated cathode substrate according to the present invention.

Oxide particles containing scandium for use in the present invention include particles of oxides of rare earth element and Sc, for example, $(Al, Sc)_2O_3$, $Sc_2W_3O_{12}$, $Ca_3Sc_2Ge_3O_{12}$, $(Ga, Sc)_2O_3$, $LiScO_2$, $LiScMoO_8$, $ScVO_4$, $(Sc, Y)_2O_3$, $Sc_4Zr_5O_{16}$, $8ZrO_2 \cdot Sc_2O_3$, etc., and they can be used alone or in mixture of at least two thereof, or in mixture with $Sc_2O_3$.

The impregnated cathode according to the present invention is prepared by impregnating an electron emissive material into pores of a porous substrate prepared through steps of weighing out the starting material powders for porous refractory body and scandium oxide powder or oxide powder containing scandium, mixing them, press-shaping the mixture and sintering the press-shaped product.

The process for the preparation of an impregnated cathode will be described in detail below:

A porous substrate is prepared from two or more kinds of starting material powders by mixing them, press-shaping the mixture into the desired cathode form, and sintering the press-shaped product. At least one of two or more kinds of the starting material powders is the known element such as tungsten, molybdenum, tantalum, rhenium (Re) or alloys containing at least one thereof, or the element capable of improving the characteristics of the electron emissive surface by its coating such as osmium, ruthenium, iridium or alloys containing at least one thereof (the most effective element as the simple substance is osmium, then ruthenium follows), and is used in mixture with other kind of the starting material powders, such as scandium oxide or oxide particles containing scandium.

Description will be made below, referring to tungsten and scandium oxide as typical species selected from the said two or more kinds of the starting material powders, and also to osmium as typical species of the element capable of improving the characteristics of the electron emissive surface by coating.

First of all, tungsten powder and scandium oxide powder are made ready. It is desirable that the particle sizes of these two powders are adjusted, preferably to be equal to each other, or the particle size of scandium oxide powder is smaller than that of tungsten powder. When a smaller mixing amount of scandium oxide powder is to be scattered in the substrate, the particle size of scandium oxide powder must be smaller than that of the tungsten powder as the host of the substrate. The tungsten powder and the scandium oxide powder thus made ready are mixed together thoroughly in an appropriate mixing proportion in a mortar, etc., and press-shaped by means of a press jig of cylindrical shape. In the press-shaping step, a binder such as polyvinyl alcohol, etc. can be used, if necessary. Then, the press-shaped product is heated in a hydrogen atmosphere at 1,000° to 1,200° C. to remove the binder when used and also to make its handling easier. Then, the presintered product is heated at 1,700° to 2,000° C. in vacuum to conduct sintering, whereby a porous substrate having a porosity of 15 to 30% by volume on the basis of the substrate, i.e. a substrate in such a structure that scandium oxide is scattered in tungsten, can be obtained. Any porosity as desired can be obtained by selecting the particle size of tungsten powder, pressure of press shaping and sintering conditions, and usually tungsten powder having particle sizes of 3–8 μm is press-shaped under a pressure of 1–10 tons/cm$^2$, and the press-shaped product is sintered at 1,700°–2,000° C. for 0.5–3 hours. When diffusion of powders themselves proceeds satisfactorily so that powder particles have been migrated, the sintered product has an uneven distribution of pores and also has many closed pores even if the porosity is the same. When the sintered product is to be shaped into a cathode form by machining, the sintered product needs a substantial strength, and thus diffusion must be made to proceed. However, when the mixture is press-shaped into a cathode form initially, the sintered product can have the necessary strength for the cathode. The amount of scandium oxide must not be more than 50% of the volume of porous substrate from the viewpoint of cost or its characteristics, and is preferably about 20% from the viewpoint of cathode strength. To obtain a remarkable effect, such as lowering in operating temperature, it must not be less than 2%. In this manner, a substrate containing scandium oxide scattered in the tungsten substrate can be obtained.

In FIG. 1, a schematic cross-sectional view of a substrate thus obtained is shown, where numeral 1 shows tungsten grains, 2 scandium oxide grains, 3 pores, and 4 porous substrate.

A barium aluminate compound is placed on the porous substrate thus obtained, and heated in a hydrogen atmosphere at about 1,700° C. to melt the barium aluminate and impregnated the pores of the substrate with barium aluminate to obtain an impregnated cathode.

The electron emissive material includes a mixture of barium carbonate, aluminum oxide, and calcium carbonate as a starting material besides the barium aluminate compound. In the ternary mixture, compositions having the best electron emission property are the following two which are at substantially equal levels: 4 moles of barium carbonate + one mole of aluminum oxide and one mole of calcium carbonate, and 5 moles of barium carbonate +2 moles of aluminum oxide +3 moles of calcium carbonate.

Figure 2:
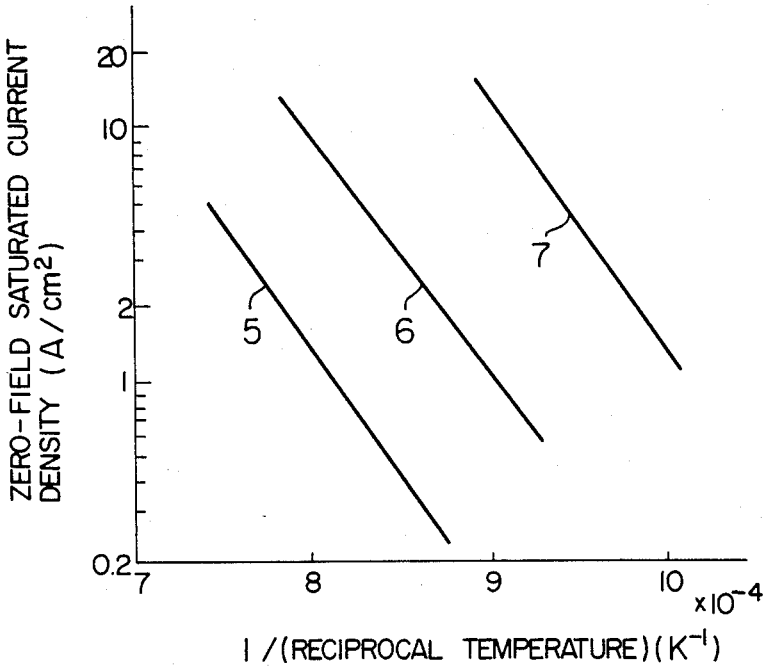
FIG. 2 is a diagram showing comparison of zero-field saturated current density between the impregnated cathode according to the prior art and that according to the present invention.

Saturated current property of the impregnated cathode thus prepared is shown in FIG. 2 as curve 7, as compared with that of the conventional impregnated cathode as curve 5 and that of the conventional impregnated cathode coated with osmium as curve 6.

The impregnated cathode of the present invention can operate at a lower temperature by about 300° C. than the conventional impregnated cathode 5 and by about 150° C. than the conventional osmium-coated impregnated cathode 6, and also evaporation rates of barium and barium oxide are lowered in the order of 1.5–3.

Figure 3:
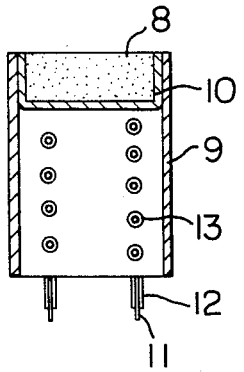
FIG. 3 is a view showing an assembly of an impregnated cathode, a sleeve, a partition layer and a heater.

As shown in FIG. 3, the impregnated cathode 8 thus prepared is used as a cathode for an electron tube in combination with a sleeve 9, a partition layer 10, and a heater consisting of a tungsten core 11 and an insulating coating layer 12 provided around the core 11. Since the operating temperature is lowered by 150°–300° C., the dissipation powder is lowered and the life of heater 13 of several ten thousand hours is obtained, which corresponds to that obtained when an oxide cathode is heated.

The conventional process is applicable to the present invention, and the operating temperatures can be made lower by 100°–300° C. than the operating temperature of the conventional impregnated cathode without changing the tube production process, as already described above, whereby the evaporation rate can be lowered in the order of 1.5–3. Thus, it can be said that the present impregnated cathode has better characteristics than the conventional impregnated cathode.

Figure 4:
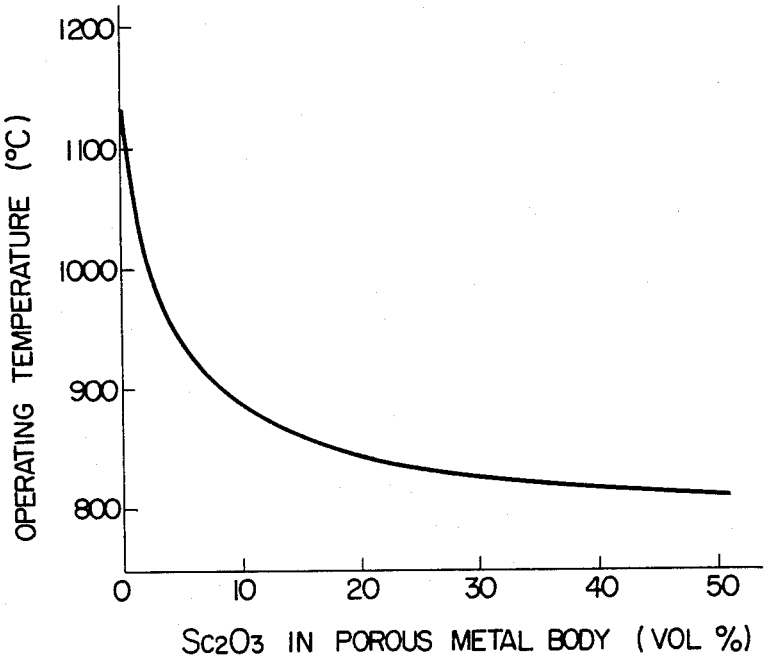
FIG. 4 is a diagram showing a temperature characteristic of the impregnated cathode according to the present invention.

In FIG. 4, relations between the volume of $Sc_2O_3$ in the substrate and the temperature for obtaining the saturated current density are shown. As is evident from FIG. 4, even slight inclusion of $Sc_2O_3$ is effective, and particularly at least at 2% by volume of $Sc_2O_3$, a better effect can be obtained than the electron emission property of the osmium-coated cathode. When oxide particles containing scandium are used in place of $Sc_2O_3$, it is preferable to use the corresponding percent by volume of scandium to that of the said single scandium oxide. For example, when $8ZrO_2 \cdot Sc_2O_3$ is used, the percent by volume of $Sc_2O_3$ in the particles must be made to correspond to that of the said single scandium oxide. Substantially same effect can be obtained thereby.

Figure 5:
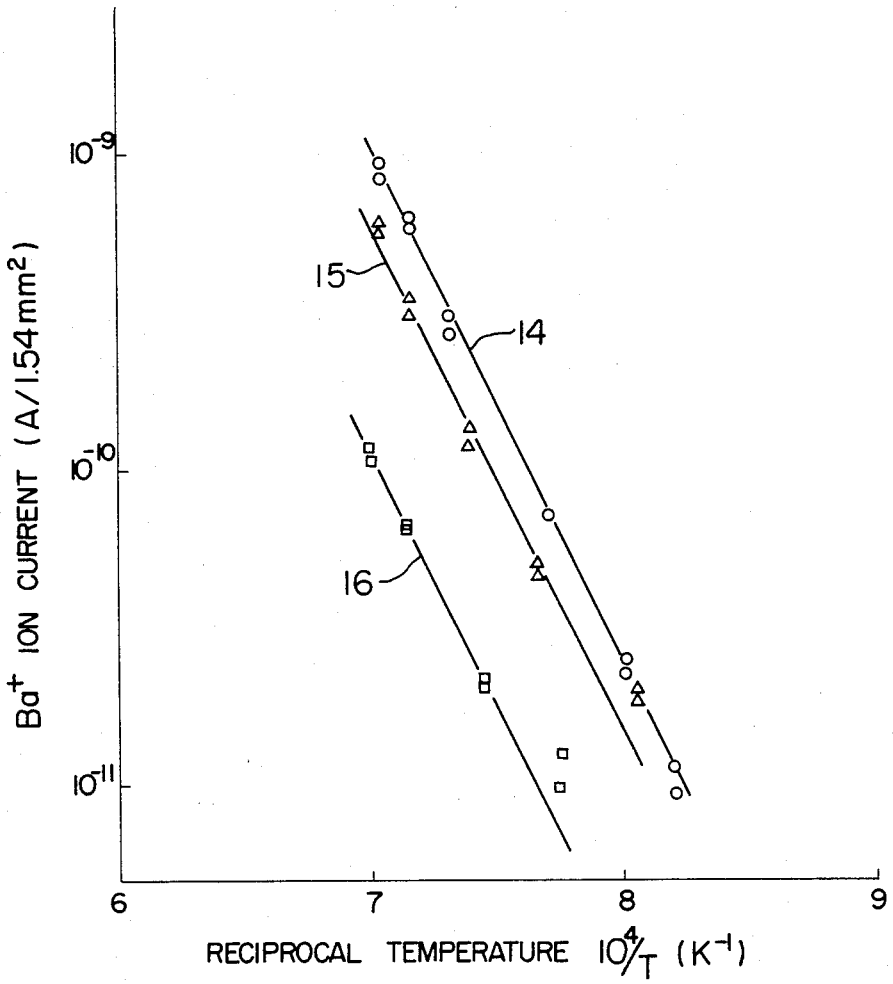
FIGS. 5 and 6 are diagrams showing dependency of barium evaporation rate upon temperature and change in barium evaporation rate with time, respectively, of the impregnated cathode according to the present invention.

Ba evaporation rate is lowered at the same temperature in the present impregnated cathode, as compared with the conventional impregnated cathode. As shown in FIG. 5, dependency of Ba evaporation rate upon temperature is shown, where the axis of ordinate shows a value of $Ba^+$ ion current when a Ba evaporation rate is measured with a mass spectrometer, which corresponds to the Ba evaporation rate. Curve 14 shows the conventional porous substate of single tungsten, curve 15 a substrate of tungsten containing 5% by weight (20.8% by volume) of $Sc_2O_3$, and curve 16 a substrate of tungsten containing 10% by weight (35.7% by weight) of $Sc_2O_3$.

Figure 6:
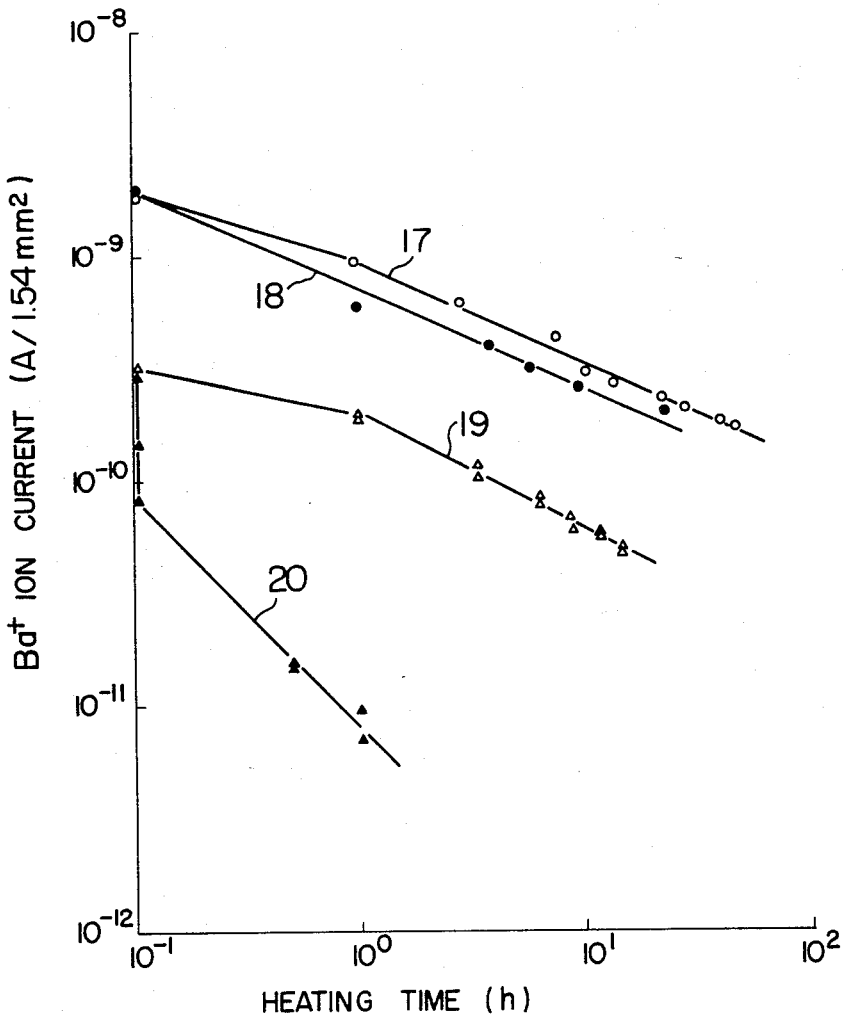

In FIG. 6, a change in Ba evaporation rate with time is shown, where the heating temperature is 1,150° C. and the axis of ordinate has the same designation as in FIG. 5. Curve 17 shows the conventional porous substrate of single tungsten, and curves 18, 19 and 20 substrates of tungsten containing 5% by weight (20.8% by volume), 10% by weight (35.7% by volume), and 16% by weight (48.8% by volume) of $Sc_2O_3$, respectively. It is obvious also from FIG. 6 that the present impregnated cathode has a better effect than the conventional one.

The present invention will be described in detail below, referring to example.

EXAMPLE

Tungsten powder having particle sizes of 5 μm and scandium oxide powder having particle sizes of 2–3 μm were made ready, and the scandium oxide powder was weighed out to obtain mixing ratios of scandium oxide of 1, 2, 4, 6, 9, 12 and 16% by weight (which corresponded to 4.8, 9.3, 17.2, 24.4, 33.1, 40.5 and 48.8% by volume, respectively), and mixed thoroughly with the tungsten powder in a mortar. Actually weighed-out amounts of scandium oxide powder had errors of ±0.1% by weight to the desired amount. Then, the mixture was press-shaped by means of a press jig of cylindrical shape, 1.5 mm in diameter. At the press shaping, polyvinyl alcohol was used as a binder. The press-shaping pressure was 4 tons/cm$^2$. The press-shaped product was then presintered in a hydrogen atmosphere at 1,000° C. for one hour to remove the binder, and make the handling easier. Then the presintered product was sintered at 1,900° C. under a pressure below $1 \times 10^{-5}$ Torr for 2 hours to prepare a porous substrate having the scandium oxide particles scattered in the substrate. The thus prepared porous substrate had a porosity of 15–24%. It was found that the porosity was lowered with increasing $Sc_2O_3$ content.

Compound each having a composition of $4BaO \cdot Al_2O_3 \cdot CaO$ and $5BaCo_3 \cdot 2Al_2O_3 \cdot 3CaO$ were placed on the porous substrate, e.g. 4 in FIG. 1, and heated and melted at 1,730°–1,740° C. in a hydrogen atmosphere (dew point: −40° C. or less) for 3 minutes to prepare an impregnated cathode having scandium oxide scattered therein. The thus obtained impreganted cathode was provided with a tantalum sleeve, e.g. 9 in FIG. 3 having a thickness of 25 μm and a tantalum barrier wall cup e.g. 10 in FIG. 3 by welding with a laser beam to prepare an indirectly heated cathode. A tungsten heater e.g. 13 in FIG. 3 was provided in the sleeve to prepare a diode tube of cathode-anode. A saturated current at the cathode of the thus prepared diode was measured with a pulse generator. The results are shown by curve 7 in FIG. 2. In FIG. 2, curve 7 shows that of a porous substrate of tungsten containing 4% by weight (17.2% by volume) of $Sc_2O_3$. It was found therefrom that the final saturated current density was proportional to the amount of scandium oxide when the amount of scandium oxide is less than 4% by weight. Above 4% by weight of $Sc_2O_3$, substantially saturated current density was obtained.

When barium evaporation energy of the thus prepared cathode was measured with a mass spectrometer, it was found to be about 3.1 kV, and the Ba evaporation rate was made lower in the order of about 1 by a decrease in temperature by 100° C.

As described above, the present invention provides an impregnated cathode having the following characteristics.

An impregnated cathode having an operating temperature lower by about 300° C. than that of the conventional impregnated cathode and by about 150° C. than that of the osmium-coated cathode can be obtained according to the present invention by preparing a porous substrate of tungsten having scandium oxide scattered therein from tungsten powder and scandium oxide powder and then forming an impregnated cathode therefrom without any change in the conventional production process or tube production process, and as a result the evaporation rate of barium (barium oxide) can be made smaller in the order of 1.5–3, and the cathode heating and dissipation power can be correspondingly lowered with the lower operating temperature. Furthermore, a load on the heater can be reduced.

When oxide particles containing scandium other than $Sc_2O_3$ is used, substantially equal effect can be obtained, so long as scandium in the particles is used in an amount corresponding to that of $Sc_2O_3$. Furthermore, substantially equal effect can be also obtained with powders of molybdenum, tantalum, rhenium and their alloys including alloys with tungsten as the host material other than scandium oxide-powder or oxide particles containing scandium.

What is claimed is:

1. An impregnated cathode which comprises a porous refractory substrate and an electron emissive material impregnated into pores in the pourous substrate, wherein said pourous refractory substrate includes at least one of scandium oxide particles and oxide particles containing scandium.

2. The impregnated cathode according to claim 1, wherein the scandium oxide particles and the oxide particles containing scandium contains 2–50% by volume of scandium in terms of scandium oxide on the basis of the porous substrate.

3. The impregnated cathode according to claim 1, wherein the oxide particles containing scandium are particles of at least one oxide selected from oxides of rare earth elements and scandium of $(Al, Sc)_2O_3$, $Sc_2W_3O_{12}$, $LiScMoO_8$, $ScVO_4$, $(Sc, Y)_2O_3$, $Sc_4ZrO_{16}$, and $8ZrO_2 \cdot Sc_2O_3$.

4. The impregnated cathode according to claim 1, wherein the porous substrate has a porosity of 15–30% on the basis of the volume of the porous substrate.

5. The impregnated cathode according to any one of claims 1 to 4, wherein said porous refractory substrate includes, in addition to said at least one of scandium oxide particles and oxide particles containing scandium, at least one metal species selected from the group consisting of tungsten, molybdenum, tantalum, rhenium and alloys of at least one thereof.

6. The impregnated cathode according to claim 1, wherein said electron emissive material impregnated into the pores in the porous substrate is barium aluminate.

7. The impregnated cathode according to claim 1, wherein said electron emissive material impregnated into pores in the porous substrate is a material from the mixture of barium carbonate, aluminum oxide and calcium carbonate as a starting material.

8. The impregnated cathode according to claim 1, wherein said porous refractory substrate includes, in addition to said at least one of scandium oxide particles and oxide particles containing scandium, at least one element selected from the group consisting of osmium, ruthenium and iridium, or alloys containing at least one thereof.

9. The impregnated cathode according to claim 5, wherein the at least one of scandium oxide particles and oxide particles containing scandium are scattered throughout said at least one metal species.

10. A process for preparing an impregnated cathode which comprises sintering a mixture of at least one metal selected from the group consisting of tungsten, molybdenum, tantalum and rhenium, and at least one of scandium oxide and oxide particles containing scandium, to thereby form a heat-resistant, porous substrate; and impregnating an electron emissive material into pores of the porous substrate.

11. Product formed by the process of claim 10.

12. The process for preparing an impregnated cathode according to claim 10, wherein, prior to sintering said mixture, the mixture is press-shaped.

13. The process for preparing an impregnated cathode according to claim 10, wherein said mixture has particles of said at least one metal and particles of said at least one of scandium oxide and oxide particles containing scandium, the particles of said at least one metal being at least as big as the particles of said scandium oxide or oxide particles containing scandium.

14. The process for preparing an impregnated cathode according to claim 13, wherein said particles of said at least one metal are the same size as the particles of said at least one scandium oxide and oxide particles containing scandium.

15. The process for preparing an impregnated cathode according to claim 9, wherein said mixture includes said at least one of scandium oxide and oxide particles containing scandium in such an amount that the porous substrate prepared by said sintering has at least one of scandium oxide particles and oxide particles containing scandium which contains 2–50% by volume of scandium in terms of scandium oxide.

16. Product formed by the process of claim 15.

* * * * *